US011336054B2

(12) United States Patent
Leong et al.

(10) Patent No.: US 11,336,054 B2
(45) Date of Patent: May 17, 2022

(54) FIRST HOUSING WITH TWO CONNECTOR PORTS SELECTIVELY CONNECTED TO ELECTRICAL CONNECTOR ON SECOND HOUSING

(71) Applicant: MOXA INC., New Taipei (TW)

(72) Inventors: Chi Hang Leong, New Taipei (TW); Mao-Hung Yang, New Taipei (TW); Chia-Hua Chang, New Taipei (TW); Chun-Yu Lin, New Taipei (TW); Sung-Wei Chou, New Taipei (TW); Tsun-Hsi Wang, New Taipei (TW)

(73) Assignee: MOXA INC., New Taipei (TW)

( * ) Notice: Subject to any disclaimer, the term of this patent is extended or adjusted under 35 U.S.C. 154(b) by 0 days.

(21) Appl. No.: 17/146,820

(22) Filed: Jan. 12, 2021

(65) Prior Publication Data

US 2021/0367376 A1 Nov. 25, 2021

(30) Foreign Application Priority Data

May 20, 2020 (TW) ..... 109116652

(51) Int. Cl.

| | |
|---|---|
| ***H01R 13/629*** | (2006.01) |
| ***H01R 13/502*** | (2006.01) |
| ***H01R 9/24*** | (2006.01) |
| ***H01R 12/52*** | (2011.01) |
| ***H01R 12/55*** | (2011.01) |
| *H01R 29/00* | (2006.01) |

(Continued)

(52) U.S. Cl.

CPC ..... *H01R 13/629* (2013.01); *H01R 9/24* (2013.01); *H01R 12/52* (2013.01); *H01R 12/55* (2013.01); *H01R 13/502* (2013.01); *H01R 12/7005* (2013.01); *H01R 13/62* (2013.01); *H01R 13/64* (2013.01); *H01R 13/665* (2013.01); *H01R 27/00* (2013.01); *H01R 29/00* (2013.01); *H01R 2107/00* (2013.01)

(58) Field of Classification Search

None

See application file for complete search history.

(56) References Cited

FOREIGN PATENT DOCUMENTS

| | | | |
|---|---|---|---|
| TW | M595908 U | 5/2020 | |
| WO | WO-2018017402 A1 * | 1/2018 | ..... G06F 1/18 |

OTHER PUBLICATIONS

Chinese language office action dated Jan. 28, 2021, issued in application No. TW 109116652.

* cited by examiner

*Primary Examiner* — Abdullah A Riyami
*Assistant Examiner* — Justin M Kratt
(74) *Attorney, Agent, or Firm* — McClure, Qualey & Rodack, LLP

(57) ABSTRACT

A connector device is provided, including a first housing, a circuit assembly, a second housing, and a connector. The circuit assembly is disposed on the first housing, and has a first connecting port and a second connecting port. The second housing is detachably engaged with the first housing. The connector is disposed on the second housing, and has an opening and a terminal. When the first housing is engaged with the second housing and the opening faces the first direction, the terminal is electrically connected to the first connecting port. When the first housing is engaged with the second housing and the opening faces the second direction, the terminal is electrically connected to the second connecting port. The first direction is different from the second direction.

8 Claims, 5 Drawing Sheets

(51) Int. Cl.

| | |
|---|---|
| *H01R 27/00* | (2006.01) |
| *H01R 13/66* | (2006.01) |
| *H01R 12/70* | (2011.01) |
| *H01R 13/64* | (2006.01) |
| *H01R 107/00* | (2006.01) |
| *H01R 13/62* | (2006.01) |

FIRST HOUSING WITH TWO CONNECTOR PORTS SELECTIVELY CONNECTED TO ELECTRICAL CONNECTOR ON SECOND HOUSING

CROSS REFERENCE TO RELATED APPLICATIONS

This application claims the benefit of Taiwan Patent Application No. 109116652, filed May 20, 2020, the entirety of which is incorporated by reference herein.

BACKGROUND OF THE INVENTION

Field of the Invention

The application relates in general to a connector device, and in particular, to a connector device which can adjust the orientation of an opening.

Description of the Related Art

A conventional connector device (such as a network switch) usually includes a plurality of sockets having the same function or different functions, so that the user needs to use many wires to connect the connector device to other apparatuses. However, the positions of the sockets in the conventional connector device are fixed, and the position where the conventional connector device is disposed is narrow (such as a rack). The wires may come from any direction of the rack, and the further limitation is in that the lengths, the positions, and the orientations of the wires are fixed. Therefore, it is hard to connect the wires to the connector device when it is disposed in the narrow rack, and the wires may be damaged due to the bending. Thus, how to address the aforementioned problem has become an important issue.

BRIEF SUMMARY OF INVENTION

An embodiment of the invention provides a connector device, including a first housing, a circuit assembly, a second housing, and a connector. The circuit assembly is disposed on the first housing, and has a first connecting port and a second connecting port. The second housing is detachably engaged with the first housing. The connector is disposed on the second housing, and has an opening and a terminal. When the first housing is engaged with the second housing and the opening faces the first direction, the terminal is electrically connected to the first connecting port. When the first housing is engaged with the second housing and the opening faces the second direction, the terminal is electrically connected to the second connecting port. The first direction is different from the second direction.

In some embodiments, the first connecting port and the second connecting port are separately arranged on the first housing.

In some embodiments, the first direction is perpendicular to the second direction. In some embodiment, the first direction is opposite to the second direction.

In some embodiments, the second housing has a first surface, a second surface, and a bottom surface. The first surface and the second surface are connected to the bottom surface, and the first surface is opposite to the second surface. The opening is disposed on the first surface. The terminal is disposed on the bottom surface and adjacent to the second surface.

In some embodiments, the first housing has a recess, an upper surface, and a lateral surface. The second housing has a top surface. When the first housing and the second housing are engaged, the second housing is accommodated in the recess, the upper surface is aligned with the top surface, and the connector does not protrude from the lateral surface of the first housing.

In some embodiments, the first housing has a guiding pillar, and the second housing has a first guiding slot and a second guiding slot. When the first housing and the second housing are engaged and the opening faces the first direction, the guiding pillar enters the first guiding slot. When the first housing and the second housing are engaged and the opening faces the second direction, the guiding pillar enters the second guiding slot.

BRIEF DESCRIPTION OF DRAWINGS

Aspects of the present disclosure are best understood from the following detailed description when read with the accompanying figures. It should be noted that, in accordance with the standard practice in the industry, various features are not drawn to scale. In fact, the dimensions of the various features may be arbitrarily increased or reduced for clarity of discussion.

DETAILED DESCRIPTION OF INVENTION

The making and using of the embodiments of the connector device are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

Figure 1:
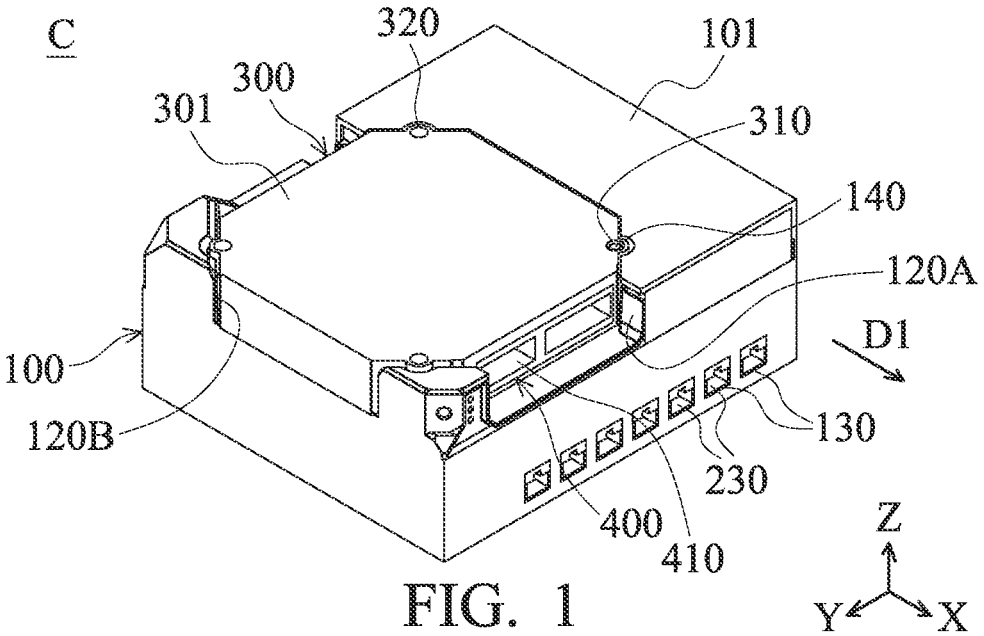
FIG. 1 is a schematic diagram of a connector device according to an embodiment of the invention.
Figure 2:
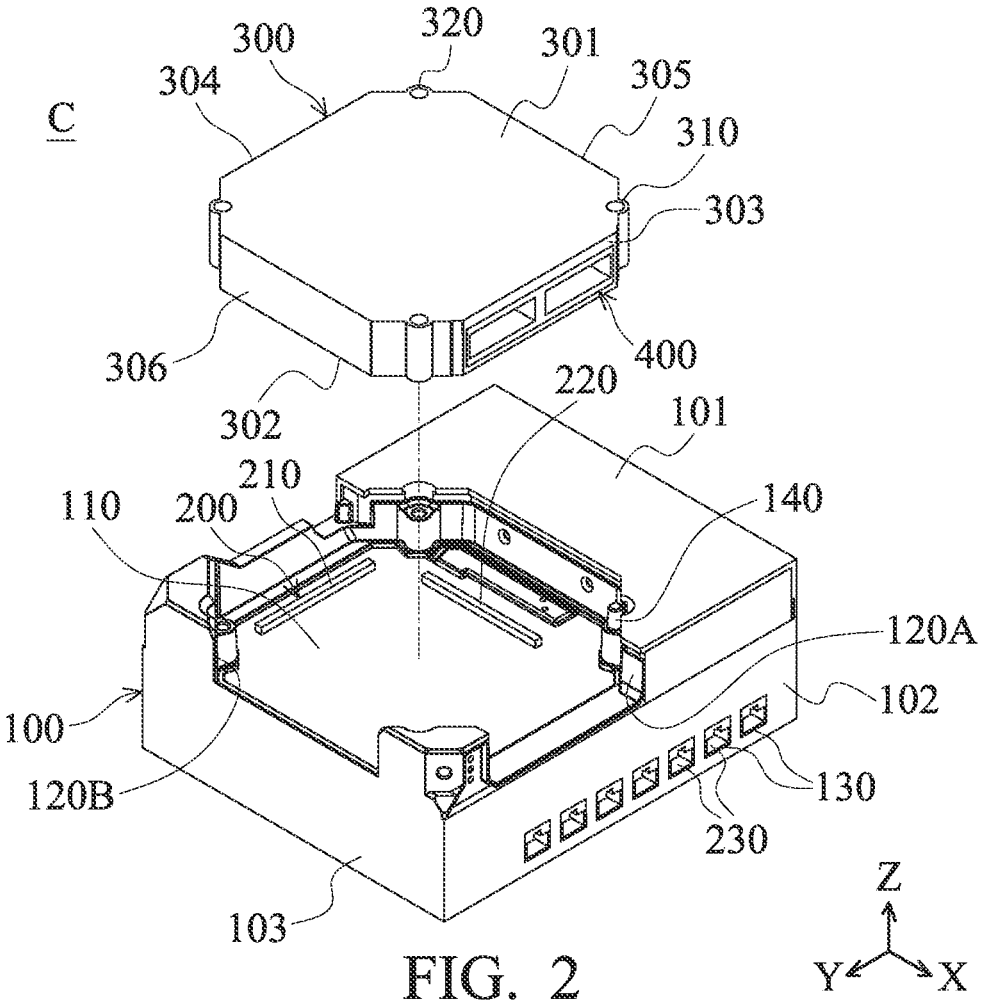
FIG. 2 is a exploded-view diagram of the connector device according to an embodiment of the invention.

Referring to FIGS. 1 and 2, in an embodiment of the invention, a connector device C primarily includes a first housing 100, a circuit assembly 200, a second housing 300, and at least one connector 400. The circuit assembly 200 is disposed on the first housing 100, the connector 400 is disposed on the second housing 300, and the first housing 100 and the second housing 300 are detachably engaged to each other.

Figure 3:
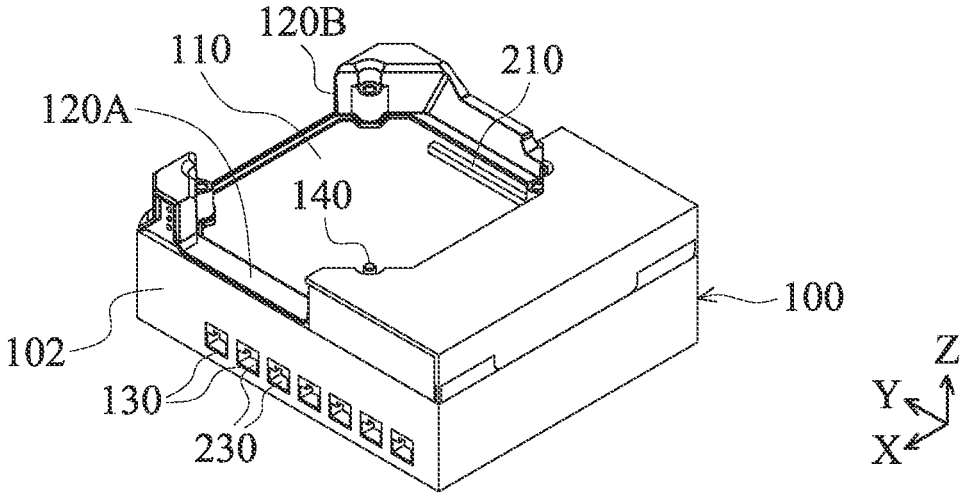
FIG. 3 is a schematic diagram of a first housing and a circuit assembly according to an embodiment of the invention.

As shown in FIGS. 2 and 3, the first housing 100 includes a recess 110, a plurality of notches 120A and 120B, and at least one connecting hole 130. The recess 110 is formed on an upper surface 101 of the first housing 100, and its cross-section shape in the XY-plane is substantially the same as that of the second housing 300. The notch 120A and the connecting hole 130 are formed on a lateral surface 102 of the first housing 100, the notch 120B is formed on another lateral surface 103 of the first housing 100, and the notches 120A and 120B are communicated with the recess 110.

The circuit assembly 200 includes a first connecting port 210, a second connecting port 220, and at least one socket 230. In this embodiment, the circuit assembly 200 is affixed inside the first housing 100, and the first connecting port 210 and the second connecting port 220 pass through the first housing and enter the recess 110. Therefore, the first connecting port 210 and the second connecting port 220 of the circuit assembly 200 can be separately arranged in the recess 110.

Specifically, the positions of the first connecting port 210 and the second connecting port 220 respectively correspond to the notches 120A and 120B. In this embodiment, each of the first connecting port 210 and the second connecting port 220 is a joint having a longitudinal structure, and the lateral surface 102 where the notch 120A formed on is perpendicular to the lateral surface 103 where the notch 120B formed on. Thus, the longitudinal axis of the first connecting port 210 is perpendicular to the longitudinal axis of the second connecting port 220.

Moreover, the socket 230 is exposed from the connecting hole 130 of the first housing 100, so that the user can insert an external plug into the socket 230 via the connecting hole 130 to electrically connect the connector device C to the external apparatus. For example, the socket 230 can include a network socket, an audio socket (such as a TRS socket or a XLR socket), a video socket (such as a VGA socket or a DVI socket), and/or an audio/video terminal (such as a HDMI socket or a DP socket), but it is not limited thereto.

In this embodiment, the first housing 100 further includes one or more guiding pillars 140. The guiding pillar 140 is disposed in the recess 110 and extended along the Z-axis. The height of the guiding pillar 140 in the Z-axis is less than or the same as the depth of the recess 110. In other words, the guiding pillar 140 does not protrude from the upper surface 101 of the first housing 100.

Figure 4:
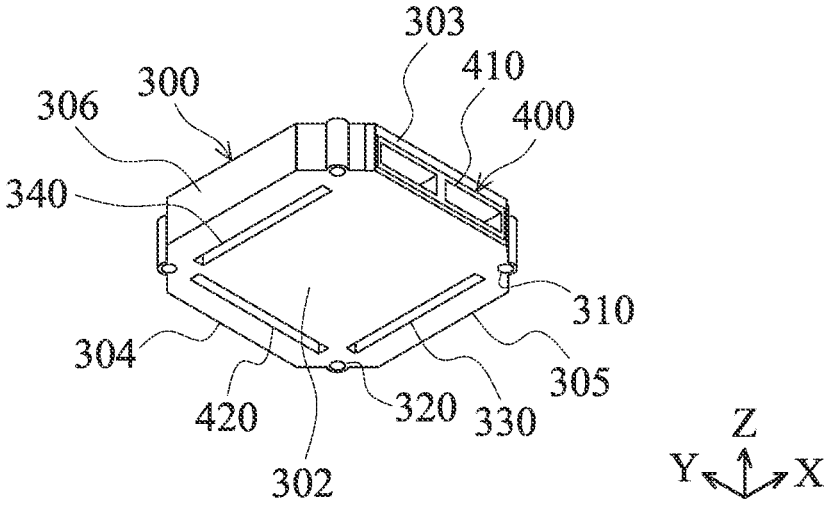
FIG. 4 is a schematic diagram of a second housing and a connector according to an embodiment of the invention.

As shown in FIGS. 2 and 4, the second housing 300 has a rotational symmetrical structure, and includes a top surface 301, a bottom surface 302, a first surface 303, a second surface 304, a third surface 305, and a fourth surface 306. The first, second, third, and fourth surfaces 303, 304, 305, and 306 connect the top surface 301 to the bottom surface 302, the first surface 303 is opposite to the second surface 304, and the third surface 305 is opposite to the fourth surface 306.

The connector 400 of the connector device C is disposed inside the second housing 300, and the opening 410 of the connector 400 is disposed on the first surface 303. The connector 400 includes a terminal 420 disposed the bottom surface 302 of the second housing 300. In this embodiment, the terminal 420 is adjacent to the second surface 304 of the second housing 300.

The second housing 300 further includes a first guiding slot 310, a second guiding slot 320, and two receiving slots 330 and 340. The first guiding slot 310 and the second guiding slot 320 are extended from the top surface 301 to the bottom surface 302 of the second housing 300. The receiving slots 330 and 340 are formed on the bottom surface 302, and respectively adjacent to the third surface 305 and the fourth surface 306. It should be noted that, the dimensions of each of the receiving slots 330 and 340 are greater than the dimensions of each of the first and second connecting ports 210 and 220.

The connector 400 can be a power connector, configured to connect an external power and having functions of voltage transformation and voltage stabilization, but it is not limited thereto.

Figure 5:
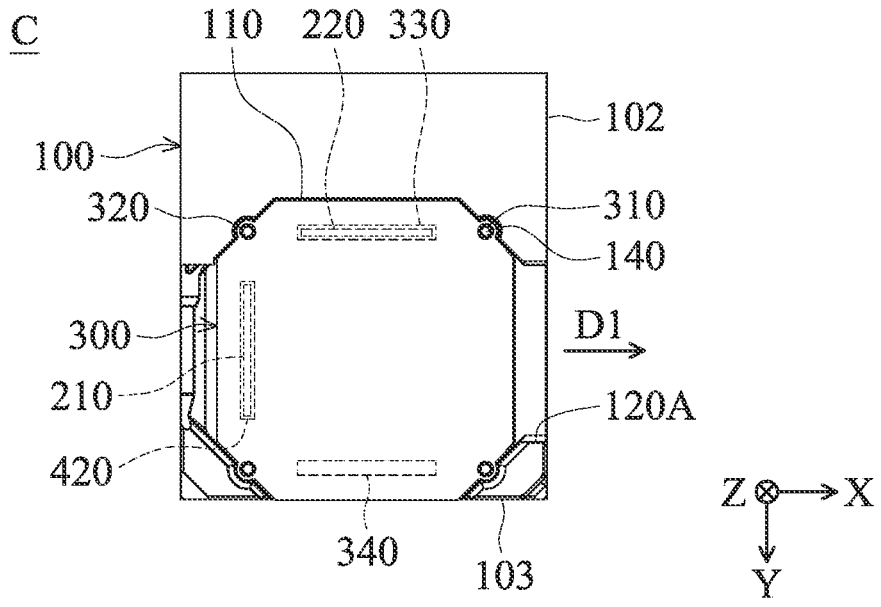
FIG. 5 is a top view diagram of the first housing and the second housing engaged to each other according to an embodiment of the invention.

The usage method of the aforementioned connector device C is discussed below. Referring to FIGS. 1 and 5, when the user desires to use the connector device C, the second housing 300 can move toward the first housing 100, and the guiding pillar 140 of the first housing 100 can enter the first guiding slot 310 of the second housing 300.

The second housing 300 can move relative to the first housing 100 along the Z-axis and enter the recess 110 by the guide of guiding pillar 140 and the first slot 310, and the first housing 100 and the second housing 300 can be engaged to each other. Since the cross-section shape of the recess 110 is substantially the same as that of the second housing 300, the orientation of the second housing 300 can be restricted. As shown in FIGS. 1 and 5, in this condition, the terminal 420 of the connector 400 is connected to the first connecting port 210, and the opening 410 of the connector 400 faces the first direction D1.

Moreover, since the depth of the recess 110 in the Z-axis is substantially the same as the thickness of the second housing 300, the upper surface 101 of the first housing 100 can be aligned with the top surface 301 of the second housing 300 when the first housing 100 and the second housing 300 are engaged, and the connector device C can achieve an integrated appearance. The storage and placement of the connector device C becomes convenient. The second connecting port 220 protruding from the bottom of the recess 110 can be received in the receiving slot 330 of the second housing 300. Therefore, the interference between the second housing 300 and the second connecting port 220 can be avoided.

The connector device C can be assembled by the aforementioned steps. The user can connect the external power to the connector device C through the opening 410 in the X-axis, and connect the external apparatus (such as a computer or a server) to the connector device C through the socket 230 in the X-axis.

It should be noted that, when the connector device C is in this condition, the opening 410 of the connector 400 is separated from the lateral surface 102 by a distance, so that the connector 400 with a large joint will not protrude from the lateral surface 102.

Figure 6:
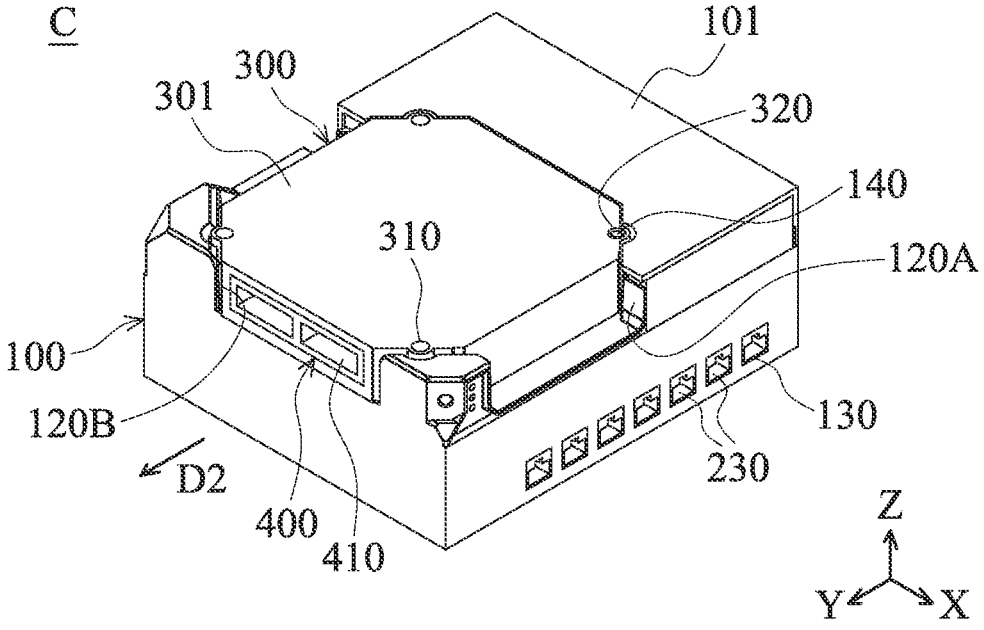
FIG. 6 is a schematic diagram of the first housing and the second housing engaged to each other in another condition according to an embodiment of the invention.
Figure 7:
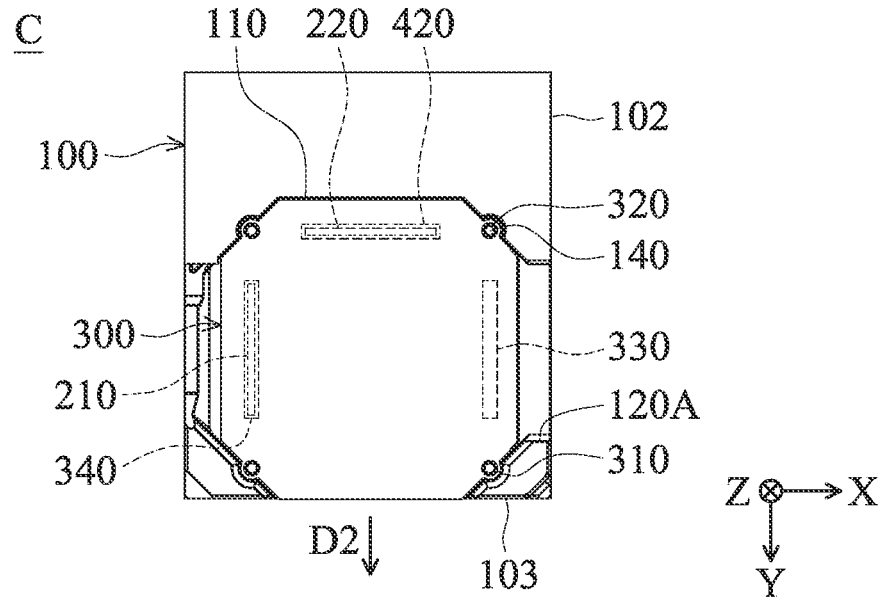
FIG. 7 is a top view diagram of the first housing and the second housing engaged to each other in another condition according to an embodiment of the invention.

Referring to FIGS. 6 and 7, when the environment where the connector device C is arranged in causes the connection wire of the external power and/or the external apparatus bending or twisting, the user can re-assemble the connector device C to change the connector device C to another condition. In detail, the second housing 300 can move toward the first housing 100, and the guiding pillar 140 of the first housing 100 can enter the second guiding slot 320 of the second housing 300.

The second housing 300 can move relative to the first housing 100 along the Z-axis and enter the recess 110 by the guide of guiding pillar 140 and the second slot 320, and the first housing 100 and the second housing 300 can be engaged to each other. As mentioned before, since the second housing 300 has the rotational symmetrical structure, the second housing 300 can be still accommodated in the recess 110 in this condition, and the orientation of the second housing 300 can be restricted. The terminal 420 of the connector 400 is connected to the second connecting port 220, and the opening 410 of the connector 400 faces the second direction D2, wherein the second direction D2 is substantially perpendicular to the first direction D1.

Similarly, when the first housing 100 and the second housing 300 are engaged in this condition, the upper surface 101 of the first housing 100 can be still aligned with the top surface 301 of the second housing 300. The first connecting port 210 can be received in the receiving slot 340 of the second housing 300 to avoid the interference between the second housing 300 and the first connecting port 210.

The connector device C can be assembled to be in another condition by the aforementioned steps. The user can connect the external power to the connector device C through the opening 410 in the Y-axis, and connect the external apparatus (such as a computer or a server) to the connector device C through the socket 230 in the X-axis.

In this embodiment, the first connecting port 210 and the second connecting port 220 are joints, so that the second housing 300 has the receiving slots 330 and 340 to avoid the interference. In some embodiments, the first connecting port 210, the second connecting port 220 and the terminal 420 are metal contacts, and the receiving slots 330 and 340 can be omitted.

Figure 8:
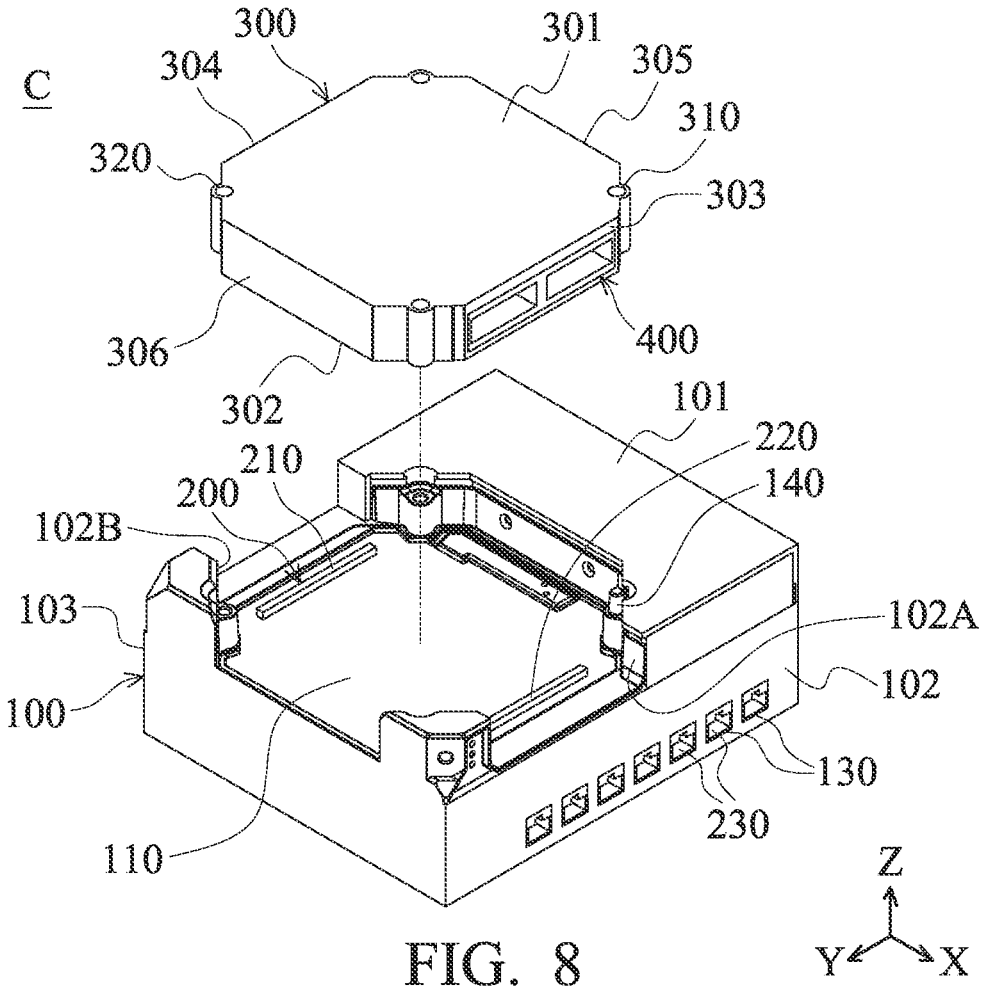
FIG. 8 is a exploded-view diagram of a connector device according to another embodiment of the invention.
Figure 9:
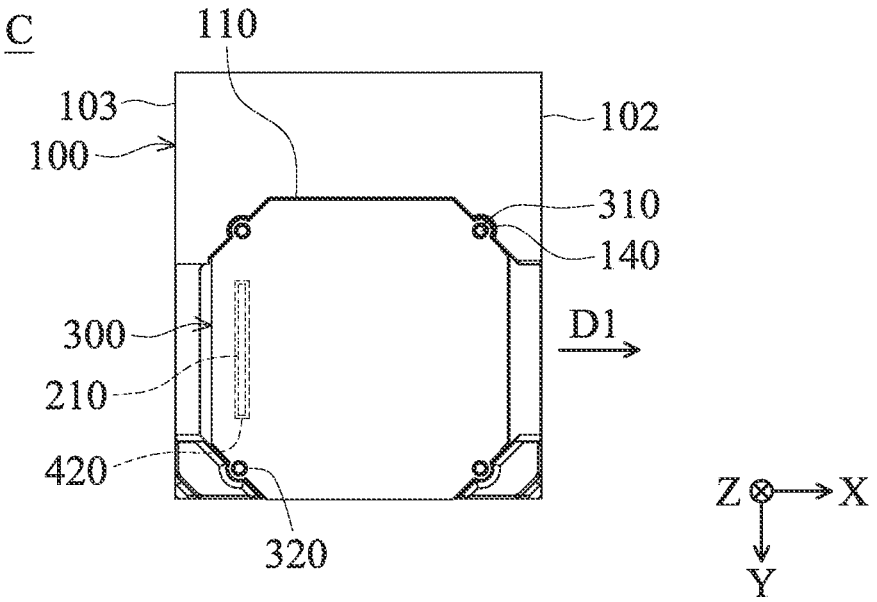
FIG. 9 is a top view diagram of a first housing and a second housing engaged to each other according to another embodiment of the invention.
Figure 10:
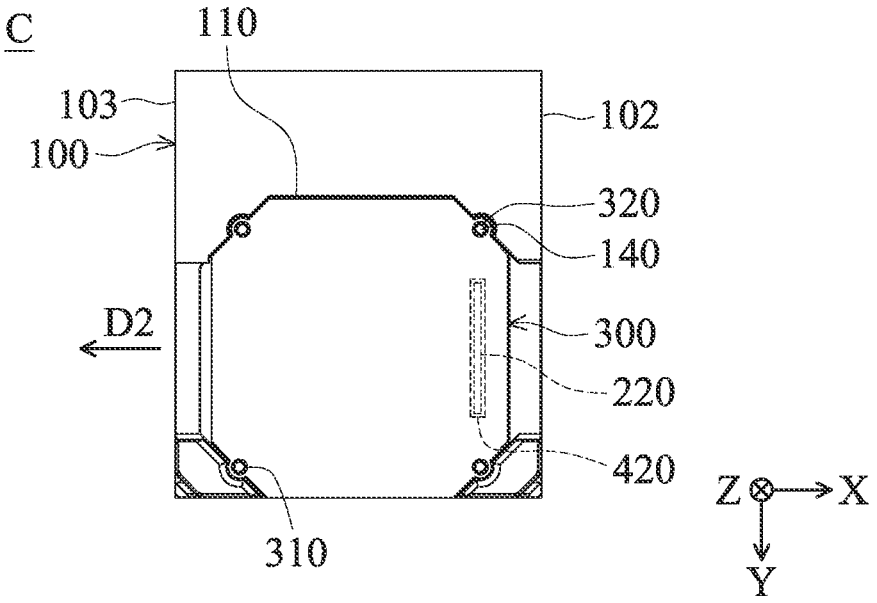
FIG. 10 is a top view diagram of the first housing and the second housing engaged to each other in another condition according to another embodiment of the invention.

Referring to FIGS. 8-10, in another embodiment, the lateral surfaces 102 where the notch 120A formed on and the lateral surfaces 103 where the notch 120B formed on are respectively disposed on the opposite side of the first housing 100, and the first connecting port 210 and the second connecting port 220 are correspondingly and respectively adjacent to the lateral surface 103 and lateral surface 102. When the terminal 420 of the connector 400 is electrically connected to first connecting port 210, the opening 410 of the connector 400 faces the first direction D1 (FIG. 9). When the terminal 420 of the connector 400 is electrically connected to second connecting port 220, the opening 410 of the connector 400 faces the second direction D2 (FIG. 10), and the first direction D1 is opposite to the second direction D2.

In summary, a connector device is provided, including a first housing, a circuit assembly, a second housing, and a connector. The circuit assembly is disposed on the first housing, and has a first connecting port and a second connecting port. The second housing is detachably engaged with the first housing. The connector is disposed on the second housing, and has an opening and a terminal. When the first housing is engaged with the second housing and the opening faces the first direction, the terminal is electrically connected to the first connecting port. When the first housing is engaged with the second housing and the opening faces the second direction, the terminal is electrically connected to the second connecting port. The first direction is different from the second direction.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A connector device, comprising:

a first housing;

a circuit assembly, disposed on the first housing, and having a first connecting port and a second connecting port;

a second housing, detachably engaged with the first housing; and a connector, disposed on the second housing, and having an opening and a terminal, wherein when the first housing and the second housing are engaged and the opening faces a first direction, the terminal is electrically connected to the first connecting port, wherein when the first housing and the second housing are engaged and the opening faces a second direction, the terminal is electrically connected to the second connecting port, and the first direction is perpendicular to the second direction.

2. The connector device as claimed in claim 1, wherein the first connecting port and the second connecting port are separately arranged on the first housing.

3. The connector device as claimed in claim 1, wherein the second housing has a first surface and a bottom surface connected to the first surface, the opening is disposed on the first surface, and the terminal is disposed on the bottom surface.

4. The connector device as claimed in claim 3, wherein the second housing further comprises a second surface, the second surface is connected to the bottom surface and opposite to the first surface, and the terminal is adjacent to the second surface.

5. The connector device as claimed in claim 1, wherein the first housing has a recess, and when the first housing and the second housing are engaged, the second housing is accommodated in the recess.

6. The connector device as claimed in claim 1, wherein the first housing has an upper surface, the second housing has a top surface, and when the first housing and the second housing are engaged, the upper surface is aligned with the top surface.

7. The connector device as claimed in claim 1, wherein the first housing has a lateral surface, and when the first housing and the second housing are engaged, the connector does not protrude from the lateral surface.

8. The connector device as claimed in claim 1, wherein the first housing has a guiding pillar, and the second housing has a first guiding slot and a second guiding slot, wherein when the first housing and the second housing are engaged and the opening faces the first direction, the guiding pillar enters the first guiding slot, wherein when the first housing and the second housing are engaged and the opening faces the second direction, the guiding pillar enters the second guiding slot.

* * * * *